United States Patent [19]

Gibson

[11] 4,037,664

[45] July 26, 1977

[54] FIRE FIGHTING-FOAM PRODUCING MODULE

[75] Inventor: John C. Gibson, Lawrence, Mass.

[73] Assignee: Gibson Motor and Machine Service, Inc., Lawrence, Mass.

[21] Appl. No.: 630,326

[22] Filed: Nov. 10, 1975

[51] Int. Cl.[2] ..... A62C 5/02; A62C 27/08

[52] U.S. Cl. ..... 169/15; 169/24; 239/149; 239/163; 239/172

[58] Field of Search ..... 239/146, 149, 159, 163, 239/170, 172; 169/24, 25, 14, 15

[56] References Cited

U.S. PATENT DOCUMENTS

| | | | |
|---|---|---|---|
| 2,799,352 | 7/1957 | Boerner et al. | 169/14 |
| 2,934,149 | 4/1960 | Bedford et al. | 169/15 |
| 3,129,890 | 4/1964 | Britton et al. | 239/159 X |
| 3,770,060 | 11/1973 | Forsyth et al. | 169/24 |
| 3,831,849 | 8/1974 | Studinger | 239/172 X |
| 3,846,515 | 11/1974 | Williamson | 169/15 X |

*Primary Examiner*—Evon C. Blunk
*Assistant Examiner*—Andres Kashnikow
*Attorney, Agent, or Firm*—Pearson & Pearson

[57] ABSTRACT

A modular fire-fighting unit can be used on the ground as an individual fire piece connected to a water source such as a hydrant, for producing foam or as a nurse unit to other fire apparatus, or it can be quickly mounted on, or demounted from, a portable source of water such as a 5,000 gallon tank truck, for producing foam to extinguish runway fires. The module includes a protein tank, an AFFF tank, an inflexible connection to a source of water, mixing valves and a motor driven pump so that foam may be dispersed from either a turret gun or an airport spreader bar.

6 Claims, 5 Drawing Figures

FIRE FIGHTING-FOAM PRODUCING MODULE

BACKGROUND OF THE INVENTION

Foam producing units have long been known for extinguishing fire, or for spreading foam on airport runways to enable crippled planes to slide to a safe landing. However, such apparatus has usually consisted in an elongated fire crash truck constructed especially for the purpose at high cost.

Prior art units, for example as shown in U.S. Pat. No. 3,129,890 to Britton of Apr. 21, 1964, have been limited to one foam generating agent only such as protein, or aqueous film forming foam (AFFF), and therefore have either been able to instantly extinguish flame or smother the fire after extinguished but not both.

It is well known to introduce a chemical into water to fight fires as disclosed in the following U.S. patents relating to proportioning, mixing, eduction, venturi throats, or the like. Pat. Nos:

U.S. 2,567,997, Granberg, 1951; 2,934,149, Bedford, 1960; 3,115,158, Sheppard, 1963; 3,667,687, Rivkind, 1972; 3,388,868, Watson, 1968; 3,642,072, Livingston, 1972; 3,701,482, Sachnik, 1972.

SUMMARY OF THIS INVENTION

In this invention, a relatively low cost, efficient module has been achieved which can be interchanged with other tank trailers, or, in the absence of a portable supply of water, the module can be removed from the tank trailer and connected to a hydrant or a stream, by unthreading two or more bolts and disconnecting the waterway to the water tank. At all times, whether on the ground, or on a tank trailer, the module is self-sufficient to produce and disperse protein foam, AFFF foam, water or any desired combination thereof.

The fire-fighting, foam-producing module includes a sub-frame supporting a platform on which the motor, pump, tanks and nozzles are mounted, the frame and platform preferably being multi-level with the motor and pump on the lower, rearward level and the foam tanks and turret nozzle on a higher forward level.

DESCRIPTION OF THE PREFERRED EMBODIMENT

Figure 1:
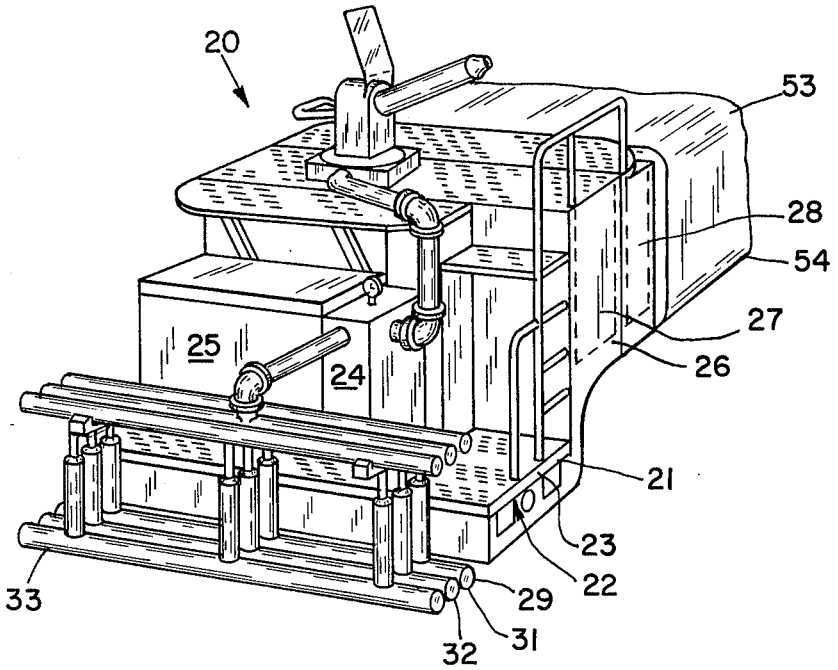
FIG. 1 is a perspective view, from the rear, of a module of the invention, dismounted from a vehicle.
Figure 2:
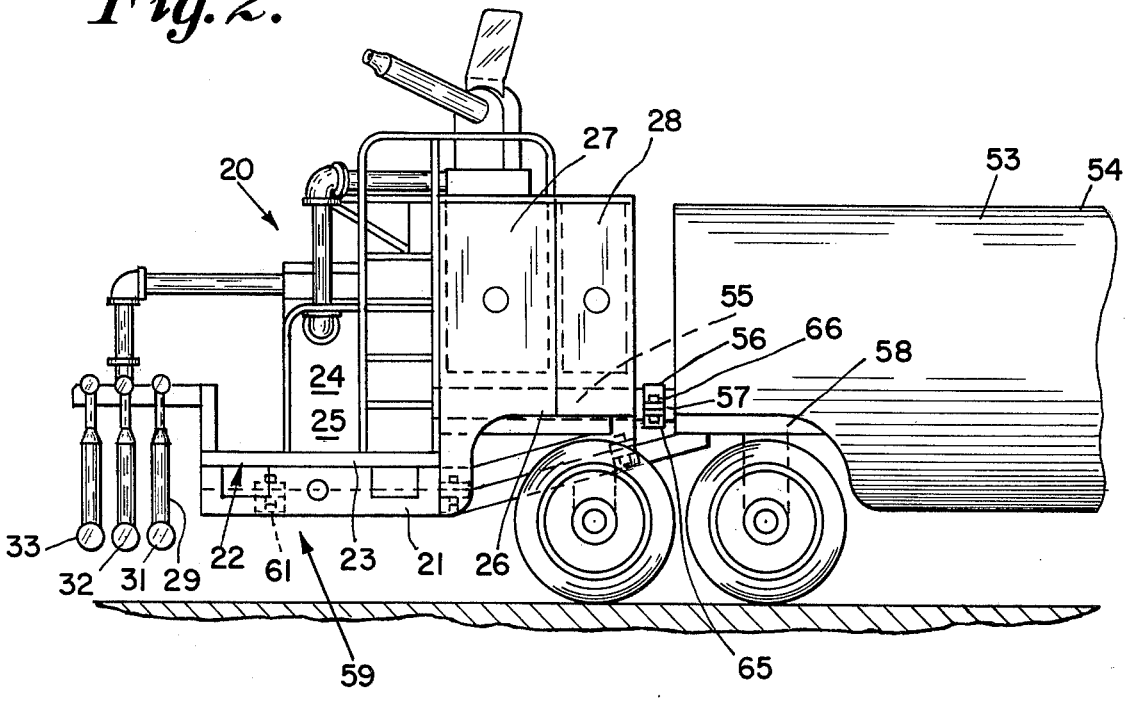
FIG. 2 is a side elevation showing the module, mounted in extension of the rearward portion of a tank vehicle.
Figure 3:
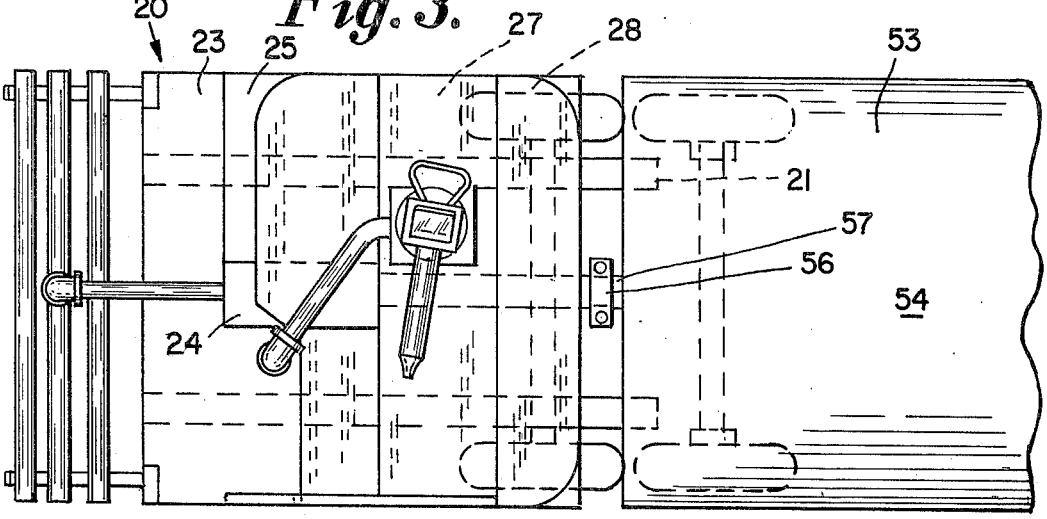
FIG. 3 is a top plan view of the module shown in FIG. 1.

A fire-fighting, foam-producing module 20, constructed in accordance with the invention, includes a sub-frame 21 to which a platform 22 is affixed by welding or similar means. The platform 22 preferably includes a rearward lower portion 23 upon which the centrifugal pump 24 and its internal combustion drive motor 25 are affixed and a forward higher level portion

26 upon which the protein tank 27 and AFFF tank 28 are affixed. At least one foam spreader bar 29, having foam discharge nozzles 31, is affixed to the module 20, there preferably being a pair of substantially identical spreader bar extensions 32 and 33 arranged to be connected to each opposite side of the main spreader 29 by quick connect couplings of a well known type, not shown.

Figure 4:
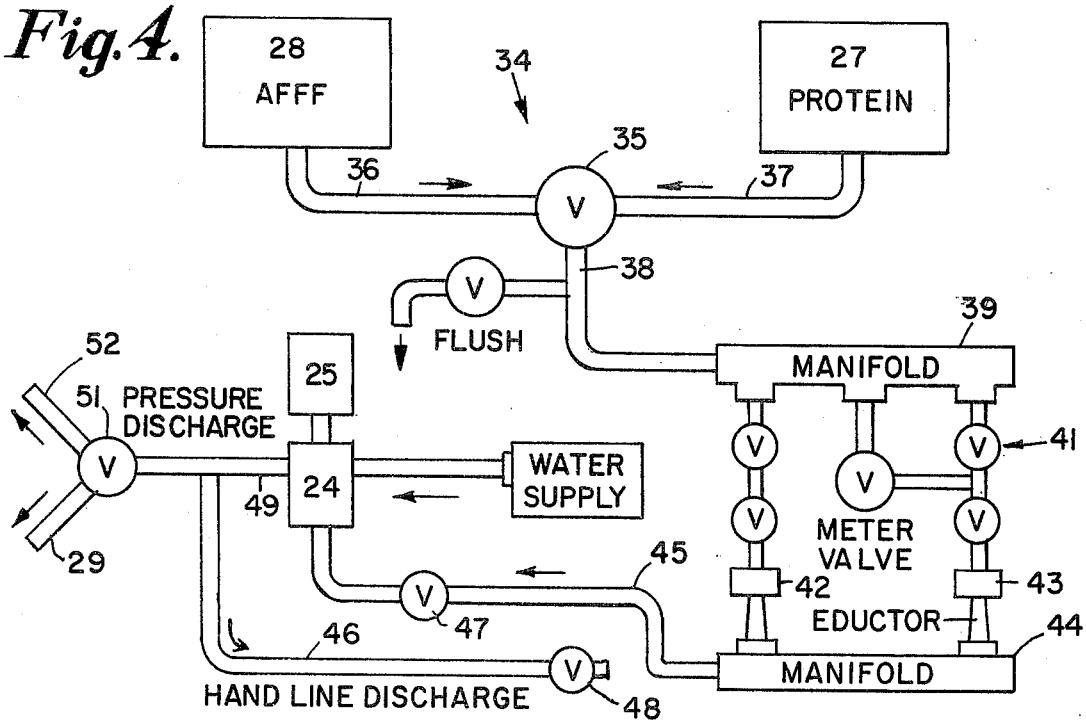
FIG. 4 is a schematic view of the flow connections of a typical such module.

As best shown in FIG. 4, mixing valve means 34 is provided in module 20 for controlling and metering the volume of AFFF or protein to be mixed with water. A three-way, swing check, or ball valve 35 selectively conducts either AFFF from tank 28 in conduit 36 or protein from tank 27 by conduit 37 to conduit 38 and thence to the manifold 39 ball check valves 41, shown, eductors 42 and 43 to manifold 44. A flush valve is provided in line 38 to flush the unit.

The liquid then flows through conduit 45 to the suction side of centrifugal pump 24, there being a shut-off valve 47 in line 45. The pressure conduit 49, from pump 24 leads to valve 51 which determines whether foam will be emitted upon striking the air from the turret gun 52 or from the spreader bar 29 and its extensions. A conduit 46 and valve 48 may be provided for hand line discharge or for a booster line on a reel.

It has been found that flexible pipe connections of the pump 24 to the water tank 53 of a tank truck or trailer 54, tend to vibrate and deteriorate. An inflexible, waterway, or pipe 55, of metal is therefore provided which extends centrally of sub-frame 21 under platform 26 from the influent, suction side of pump 24 to a quick release threaded coupling 56 which may be coupled to the outlet 57 of the water tank 53 or to a hose leading from any source of water such as a hydrant 60, pond, stream or a separate tank truck. Coupling 56 has oppositely disposed flanges such as 65, which are clamped together by second threaded bolt and nut means 66, to make a water tight, but readily detachable connection.

Figure 5:
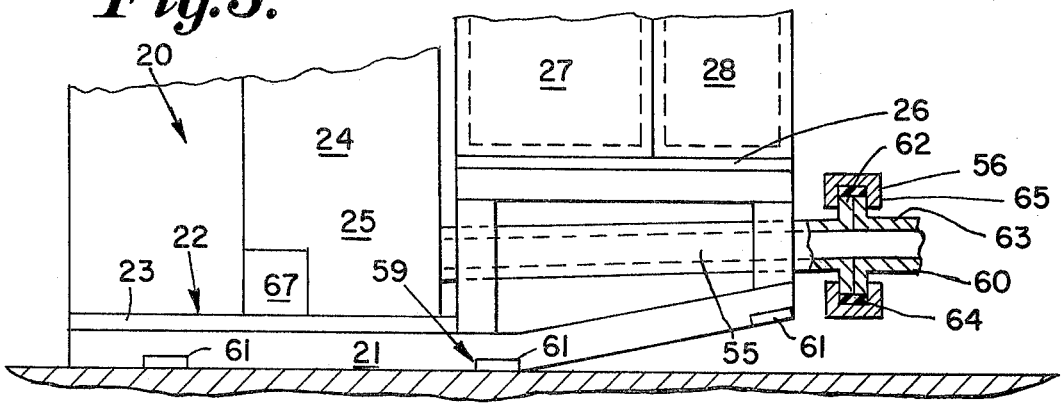
FIG. 5 is an enlarged fragmentary side elevation showing the inflexible waterway conduit quick release coupling and the quick detachable module frame connection to the main frame of the vehicle. The module being shown connected to a hydrant.

As best shown in FIG. 5, the quick release means detachably connecting sub-frame 21 to the main frame 58 of a trailer, or tank truck 54 comprises first threaded bolt and nut means 59 which is readily accessible to enable the module 20 to be easily mounted and dismounted. Means 59 preferably includes six sets of brackets 61, each pair spaced along the sub frame 21 and fastened by bolt and nut means 59.

Thus the module may be removed from the frame by unfastening eight bolts, six for the frame and two for the waterway coupling 56.

An auxiliary pump 67, driven by motor 25 is also provided for pumping use when desired.

Coupling 56 is preferably a "Victaulic" coupling made by Victaulic Company of America, South Plainfield, New York. Inflexible waterway 55 has an annular flange 62 and tank outlet 57 has a similar flange 63, the coupling 56 having a rubber gasket 64.

Preferably protein tank 27 has a volume of about 500 gallons, and AFFF tank has a volume of about 300 gallons when mounted on a water tank vehicle capable of holding about 5000 gallons of water.

I claim:

1. A fire-fighting, foam-producing, module usable as an independent unit connected to a hydrant water supply or as a portable, vehicle-mounted, unit connected to the water tank of a water tank truck, as a water supply said module comprising:

a sub-frame supporting a platform;

internal combustion engine driven, fluid pump means mounted on said platform;

at least one foam spreader bar, mounted at the rear of said module and connected to the outlet of said pump, said spreader bar having a plurality of nozzles for dispersing pumped fluid on a fire;

an inflexible, water way conduit having one end connected to the inlet of said pump and having its other end detachably coupled to one of said water supplies, a pair of tanks mounted on said platform, one tank containing aqueous film forming foam composition and the other tank containing protein composition, mixing valve means, including conduits leading from each said tank into said pump means for selectively introducing one said composition, the other said composition or both, into the water pumped from said water supply, and quick release means for detachably affixing said sub-frame on said tank truck.

2. A fire-fighting, foam-producing module as specified in claim 1 plus:

a turret type nozzle mounted on top of said pair of tanks and conduit means, including a control valve, connecting said nozzle to the outlet of said pump.

3. A fire-fighting, foam producing module as specified in claim 1 wherein:

said protein composition tank and said aqueous film forming foam composition tank bear a volume relationship of 500 to 300.

4. A fire-fighting foam producing module as specified in claim 1 wherein:

said sub-frame and platform is characterized by a rearward portion supporting said engine driven pump at a predetermined level and a forward portion supporting said pair of tanks, at a substantially higher level.

5. A fire-fighting, foam producing module, as specified in claim 1 wherein:

said water tank truck has a main frame and a tank outlet, said quick release means comprises first threaded bolt and nut means connecting said sub frame to said main frame of said water tank truck and a coupling clamp fastened by a second threaded bolt and nut means connecting the other end of said inflexible waterway conduit to said tank outlet of said truck.

6. In apparatus of the type adapted to apply foam to airport runways, said apparatus including an elongated, trailer type vehicle having a water tank and an elongated main frame; a foam tank, a motorized pressure pump; at least one foam discharge nozzle and control valve and conduit means connecting said nozzle to said pump and said pump to said tanks the combination of an individual multi-level sub-frame and platform, upon which said foam tank, pump, motor and nozzles are affixed;

a second foam tank, mounted on said platform and connected to said pump;

first threaded bolt means detachably connecting said sub-frame and platform in rearward extension of said elongated main frame of said vehicle, and an inflexible water way conduit connecting said pump with said water tank, by quick detachable coupling means including second threaded bolt means, said sub-frame, platform, pump, motor, foam tanks, discharge nozzle and control valve and conduit means forming a detachable module which may be readily dismounted from in rearward extension of said trailer-type vehicle to serve as an individual, self-sufficient foam producing unit connectable to a hydrant, stream, pond or separate tank vehicle.

* * * * *